US007470012B2

(12) United States Patent
Kojima et al.

(10) Patent No.: US 7,470,012 B2
(45) Date of Patent: Dec. 30, 2008

(54) LIQUID STORAGE CONTAINER AND LIQUID EJECTION RECORDING APPARATUS HAVING THE CONTAINER MOUNTED THEREON

(75) Inventors: Yoshinori Kojima, Kawasaki (JP); Toshihiko Ujita, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 427 days.

(21) Appl. No.: 11/390,835

(22) Filed: Mar. 28, 2006

(65) Prior Publication Data

US 2006/0221153 A1 Oct. 5, 2006

(30) Foreign Application Priority Data

Mar. 31, 2005 (JP) ..... 2005-101929

(51) Int. Cl.
*B41J 2/175* (2006.01)

(52) U.S. Cl. ..... 347/86

(58) Field of Classification Search ..... 347/85, 347/86, 87

See application file for complete search history.

(56) References Cited

U.S. PATENT DOCUMENTS 5,453,772 A * 9/1995 Aono et al. ..... 347/87
5,767,882 A * 6/1998 Kaplinsky et al. ..... 347/87
6,494,568 B2 * 12/2002 Hou et al. ..... 347/86
6,663,233 B2 * 12/2003 Otsuka et al. ..... 347/85
6,739,712 B2 * 5/2004 Kim ..... 347/87
6,773,099 B2 * 8/2004 Inoue et al. ..... 347/86
6,935,739 B2 * 8/2005 Inoue et al. ..... 347/104

FOREIGN PATENT DOCUMENTS

CN 2421158 2/2001
JP 6-198904 A 7/1994

* cited by examiner

*Primary Examiner*—Anh T. N. Vo
(74) *Attorney, Agent, or Firm*—Canon USA Inc IP Div

(57) ABSTRACT

A reliable ink cartridge that reduce printing nonconformity even during high speed inkjet-recording with multiple nozzles by alleviating rapid external impact applied from the outside of the ink cartridge. Within a casing of an ink cartridge, a flexible bag forming an ink reservoir is accommodated. Between the surface of the flexible bag where a sheet member is bonded and a wall surface of the casing, a stress damping chamber is provided. The stress damping chamber communicates with the atmosphere outside the ink cartridge via an orifice formed on a wall surface of the casing.

5 Claims, 8 Drawing Sheets

LIQUID STORAGE CONTAINER AND LIQUID EJECTION RECORDING APPARATUS HAVING THE CONTAINER MOUNTED THEREON

BACKGROUND OF THE INVENTION

1. Field of the Invention

The present invention relates to an ink cartridge for storing ink therein to be fed to an inkjet recording head and an inkjet recording apparatus having the ink cartridge mounted thereon.

2. Description of the Related Art

Various types of ink cartridge have been proposed. An ink cartridge is a liquid storage container storing ink therein for feeding the ink to an inkjet recording apparatus. Ink cartridges are roughly classified into three types as follows.

A first type is a so-called whole sponge type for retaining ink by arranging a capillary material, such as a sponge, within the entire internal space of the ink cartridge. A second type is a so-called whole raw ink type directly storing ink in a bag without using such a capillary material. A third type is a so-called semi-raw ink type in that one half of the ink cartridge is provided with the capillary material while the other half is provided with a raw ink chamber for directly storing ink within a casing.

In order to preferably feed ink to the recording head for ejecting the ink, in any of these types of ink cartridges, a configuration for adjusting holding power of the ink stored in the ink cartridge is important. Since this holding power is for leaving the pressure of an ink ejection part of the recording head negative relative to the atmosphere, the holding power is called a negative pressure.

In the whole sponge type mentioned above, ink is retained due to the characteristics of the capillary material and the negative pressure applied to the ink, so that this type has been adopted in various products.

However, in the whole sponge type, the amount of ink retained in the ink cartridge is small in ratio in comparison with the whole raw type. Also, since the negative pressure level and the flow resistance are increased just before ink is used up, the ink remains within the sponge, so that the available ink amount is smaller than the entire volume of the ink cartridge, i.e., the storing efficiency is small. Thus, a whole raw type ink cartridge is proposed in which a spring member is provided in an ink bag for urging the ink bag so as to maintain the bag at a negative pressure in order to increase the ink capacity per unit volume of the ink cartridge and also to achieve stable ink feeding (Japanese Patent Laid-Open No. H06-198904).

FIG. 6 is an exploded view of an ink cartridge having the configuration disclosed in Japanese Patent Laid-Open No. H06-198904, and FIG. 7 shows the interior of the ink cartridge being urged so as to maintain it under negative pressure.

An ink cartridge 10 shown in FIG. 6 includes a plastic frame 16 defining an open space serving as an ink reservoir. Within the open space of the frame 16, a pressure regulator 30 is accommodated for maintaining the interior at a negative pressure. On one side of the open space of the frame 16 is provided a flexible thin film 22 bonded to the plastic frame so as to close the one side of the open space. A hard cover plate 12 is bonded with an adhesive on the thin film 22 so as to cover it. On the other side of the open space is provided a flexible thin film 24 bonded to the plastic frame so as to close the open space. A hard cover plate 14 is bonded with an adhesive on the thin film 24 so as to cover it. Thereby, a flexible ink reservoir having a pressure regulator 30 accommodated therein is formed within the ink cartridge 10.

A tip portion 13 of the ink cartridge 10 is provided with an ink ejection nozzle arranged on the bottom end wall, to which a print head (not shown) is mounted and electrically driven.

The pressure regulator 30 includes a pair of plates 40 and 50 spaced in parallel with each other and urged with a bow spring 60 in a direction separating each other so as to move into engagement with the thin films 22 and 24 forming the flexible ink reservoir, respectively. An ink filter 18 is provided at a position inside the frame 16 and corresponding to the tip portion 13. The ink filter 18 is communicated with the ink reservoir by an appropriate porting element and includes an ink outlet communicated with the print head.

Under no stress conditions, the bow spring 60 is shaped as shown in solid lines of FIG. 7. When ink is fed outside the ink cartridge 10 from the ink reservoir, the thin films 22 and 24 move close to each other. Along with this movement, the side plates 40 and 50 of the pressure regulator 30 also move gradually so as to approach each other. Thereby, the side plates 40 and 50 and the bow spring 60 move to a mid point as shown by two-dot chain lines of FIG. 7. At this time, the bow spring 60 for urging the ink reservoir is compressed, so that the negative pressure level in the ink reservoir is increased.

In the ink cartridge configured as described above, if an external impact is directly transmitted to the thin films forming the ink reservoir, the thin film may be torn, causing ink leakage. This also applies large vibration to the ink stored in the flexible ink reservoir so that the ink supply to the head becomes unstable, which may cause printing nonconformity.

SUMMARY OF THE INVENTION

The present invention is directed to an ink cartridge and an inkjet recording apparatus incorporating the same which prevent printing nonconformity even during high speed inkjet-recording with multiple nozzles by alleviating rapid external impact applied from the outside of the ink cartridge.

Furthermore, the present invention provides an ink cartridge capable of sufficiently feeding ink without affecting the ink supply when the negative pressure level in the ink cartridge is rapidly increased by the increase in the ink supply per unit time from the ink cartridge to the inkjet head along with high speed inkjet-recording with multiple nozzles or by the temporary increase in the ink supply from the ink cartridge during recovery operation of the inkjet head, even when having an alleviation structure for external impact. The present invention also solves the possible problem in that even when having an alleviation structure for external impact, the negative pressure level in the ink cartridge is increased by the increase in ink resistance due to changes in ink physical property (especially in viscosity) so that ink does not flow smoothly.

In one aspect of the present invention, a liquid storage container includes a liquid reservoir adapted to store a liquid therein; a first spring member accommodated within the liquid reservoir and urging the liquid reservoir so as to maintain the interior of the liquid reservoir at a negative pressure; a casing having a wall and accommodating the liquid reservoir therein; a supply port formed on the wall and facilitating supplying the liquid in the liquid reservoir to the outside; and a stress damping unit provided between the liquid reservoir and the wall of the casing, the stress damping unit damping stress applied to the liquid reservoir.

According to the present invention, a reliable ink cartridge and inkjet recording apparatus can be provided, which reduce printing nonconformity even during high speed inkjet-recording with multiple nozzles by alleviating rapid external impact applied from the outside of the ink cartridge.

Further features of the present invention will become apparent from the following description of exemplary embodiments with reference to the attached drawings.

DESCRIPTION OF THE EMBODIMENTS

Embodiments according to the present invention will be described with reference to the drawings. In the following embodiments, ink is exemplified as a liquid in the ink cartridge. However, the liquid is not limited to ink and may also include a processing liquid for a recording medium in inkjet recording.

First Embodiment

Figure 1:
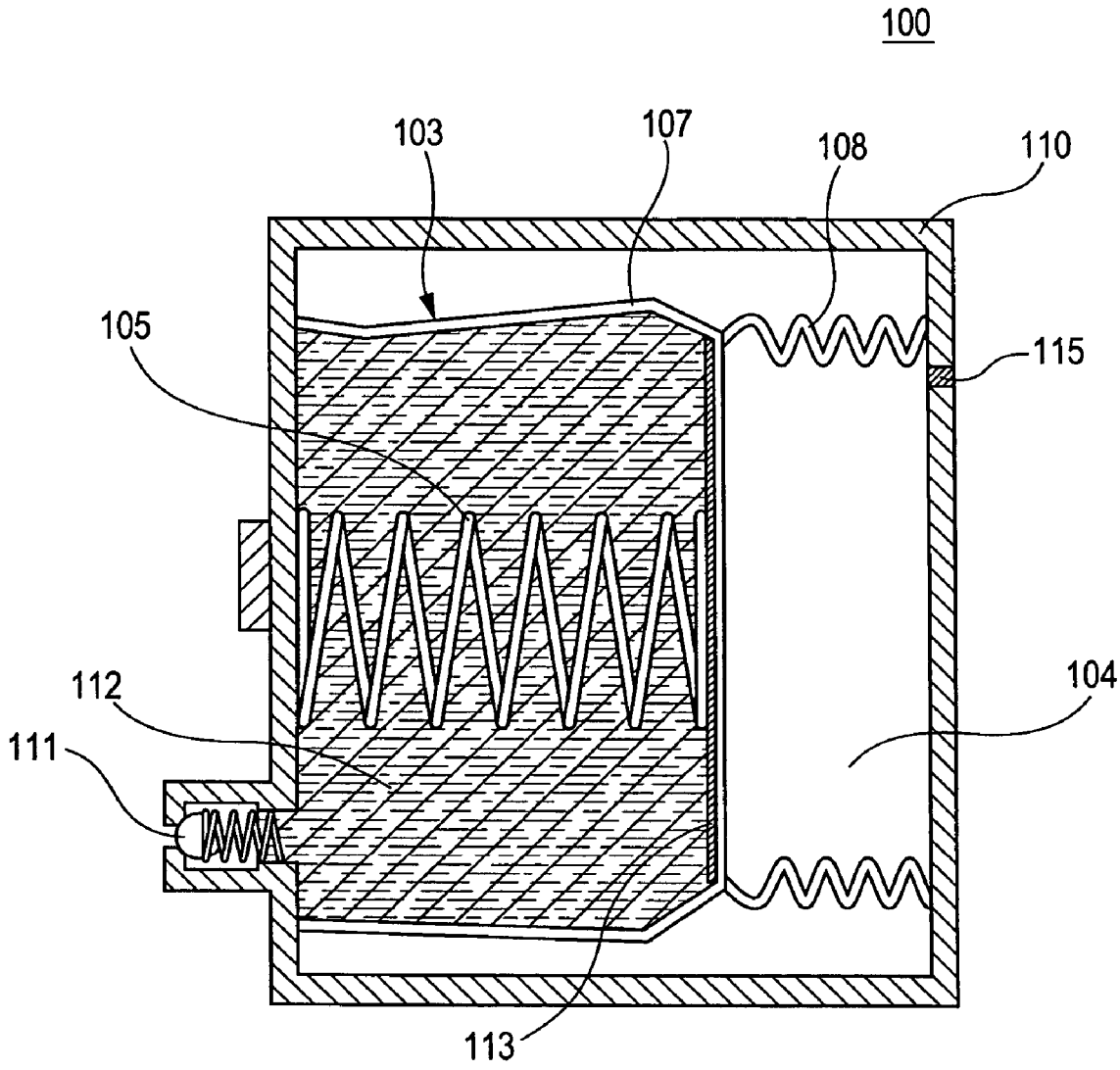
FIG. 1 is a sectional view of an ink cartridge according to a first embodiment of the present invention.

FIG. 1 is a sectional view of an ink cartridge according to a first embodiment of the present invention.

An ink cartridge (liquid container) 100 shown in FIG. 1 includes a hard casing 110 having an interior space and an ink supply port 111 formed on the wall of the casing 110 for supplying ink 112 (shown by reticular lines in the drawing) to the outside.

Within the casing 110, a film-like flexible bag 107 is accommodated for storing the ink 112 therein. The opening of the flexible bag 107 is joined onto the wall position where the ink supply port 111 is formed so as to form an ink reservoir 103. A sheet member 113 is provided on a portion of the flexible bag 107 opposing the wall position of the casing 110 where the ink supply port 111 is formed for flattening the portion. Between the wall position of the casing 110 where the ink supply port 111 is formed and the sheet member 113, a compression spring 105 is provided for urging the flexible bag 107 in a direction expanding the flexible bag 107. That is, the compression spring 105 urges the flexible bag 107 so as to maintain the interior of the flexible bag 107 at a negative pressure.

Between the surface of the flexible bag 107 where the sheet member 113 is bonded and the wall surface of the casing 110, a stress damping chamber 104 is formed for damping the stress applied to the flexible bag 107. The stress damping chamber 104 and the ink reservoir 103 are arranged in series in an expansion/contraction direction of the compression spring 105. The stress damping chamber 104 is formed by joining one opening of an elastically flexible cylinder 108 (such as a bellows, and the flexible cylinder 108 itself applies no stress to the flexible bag 107) on the surface of the flexible bag 107 where the sheet member 113 is bonded as well as by joining the other opening on the wall surface of the casing 110.

The wall surface where the other opening of the flexible cylinder 108 is attached is provided with an orifice 115 formed thereon. The stress damping chamber 104, which is an air chamber, is communicated with the atmosphere outside the ink cartridge via the orifice 115 formed on the wall surface of the casing 110. The orifice 115 allows air to promptly flow in the chamber in accordance with the displacement of the flexible bag 107 accompanied by ink consumption due to the normal operation of the ink cartridge mounted on a printer. However, if an external impact is applied so as to promptly displace the flexible bag 107, the flexible cylinder 108 is also displaced rapidly along with the displacement of the flexible bag 107. At this time, the volume of the stress damping chamber 104 formed of the flexible cylinder 108 changes. Due to this change, outside air of the stress damping chamber 104 may be pulled in or inside air may be extruded. At this time, the orifice 115 serves as a resistance against the rapid air flow so as to suppress the displacement of the flexible bag 107 by inhibiting the displacement of the stress damping chamber 104. That is, the stress damping chamber 104 serves as a shock absorber using the resistance during air flow into and out through the orifice 115 due to the expansion/contraction of the flexible cylinder 108.

In the ink cartridge 100 structured as described above, an external impact applied from the outside of the ink cartridge is attenuated by the stress damping chamber 104, so that the impact is not directly transmitted to the flexible bag 107 forming the ink reservoir 103. Thereby, the flexible bag 107 may not be damaged by the impact so as to prevent ink leakage.

The vibration of ink within the flexible bag 107 due to an external impact can also be suppressed, so that the ink can be stably supplied to the inkjet head.

Second Embodiment

Figure 2:
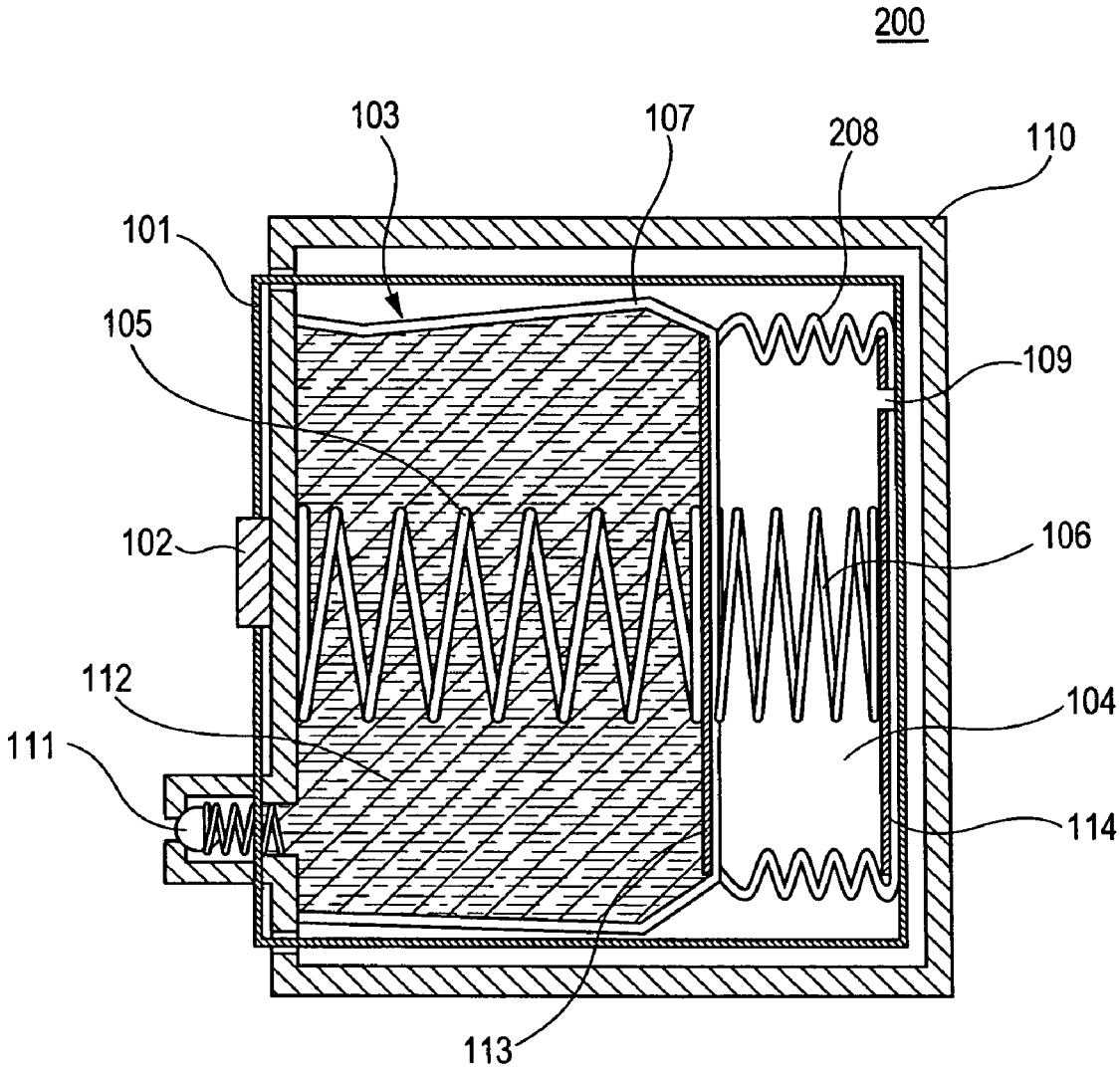
FIG. 2 is a sectional view of an ink cartridge according to a second embodiment of the present invention.

FIG. 2 is a sectional view of an ink cartridge according to a second embodiment of the present invention. Like reference characters designate like components common to the first embodiment.

An ink cartridge 200 shown in FIG. 2 includes the hard casing 110 having an interior space and the ink supply port 111 formed on the wall of the casing 110 for supplying the ink 112 (shown by reticular lines in the drawing) to the outside.

Within the casing 110, the film-like flexible bag 107 is accommodated for storing the ink 112 therein. The opening of the flexible bag 107 is joined onto the wall position where the ink supply port 111 is formed so as to form the ink reservoir 103. The sheet member 113 is bonded on a portion of the flexible bag 107 opposing the wall position of the casing 110 where the ink supply port 111 is formed for flattening the portion. Between the wall position of the casing 110 where the ink supply port 111 is formed and the sheet member 113, the compression spring 105 is provided for urging the flexible bag 107 in a direction expanding the flexible bag 107. That is, the compression spring 105 urges the flexible bag 107 so as to maintain the inside of the flexible bag 107 at a negative pressure.

Between the surface of the flexible bag 107 where the sheet member 113 is bonded and the wall surface of the casing 110, the stress damping chamber 104 is formed. The stress damping chamber 104 and the ink reservoir 103 are arranged in series in an expansion/contraction direction of the compression spring 105.

The structure described above is the same as that of the first embodiment. Whereas, the following configuration is different from that of the first embodiment.

According to the second embodiment, the stress damping chamber 104 is formed by joining an opening of a flexible bag 208 on the surface of the flexible bag 107 where the sheet member 113 is bonded. The flexible bag 208 can expand/contract like a bellows.

A sheet member 114 is bonded on a portion of the flexible bag 208 opposing the sheet member 113 of the flexible bag 107 for flattening the portion. Between the surface of the flexible bag 107 where the sheet member 113 is bonded and the sheet member 114, a compression spring 106 is arranged substantially in series with the compression spring 105 in an expansion/contraction direction. Thereby, the sheet members 113 and 114 are urged in a direction in which the sheet members move apart. The stress damping chamber 104 is communicated with the atmosphere via an air inlet 109 penetrating the sheet member 114 and the flexible bag 208 which is bonded to the sheet member 114.

Within the casing 110, a shape-memory alloy wire 101 capable of expanding/contracting by electric energy is arranged so as to surround parts of a bonded structure composed of the flexible bag 107 and the flexible bag 208. Parts of the shape-memory alloy wire 101 are mechanically fixed on the surface of the flexible bag 208 where the sheet member 114 is bonded, while both ends of the shape-memory alloy wire 101 are connected to an electric contact block 102 arranged on the outer wall of the casing 110 where the ink supply port 111 is formed. In a state of the shape-memory alloy wire 101 arranged in such a manner, as shown in FIG. 2, the flexible bag 208 is constrained by the shape-memory alloy wire 101 in a contracting direction against the repulsive force of the compression spring 106.

Since the compression springs 105 and 106 are arranged within the flexible bags 107 and 208, respectively, at the center, the shape-memory alloy wire 101 surrounding the bonded structure composed of the flexible bags 107 and 208 is arranged so as to pass through the center of the surface of the flexible bag 208 where the sheet member 114 is bonded. By such a manner, when the shape-memory alloy wire 101 is contracted, the flexible bags 107 and 208 can be contracted in a well-balanced state.

The relationship in force (repulsive force and contractive force) among the compression spring 105 of the ink reservoir 103, the compression spring 106 of the stress damping chamber 104, and the shape-memory alloy wire 101 is as follows.

"the contractive force of the shape-memory alloy wire 101>the repulsive force of the compression spring 105>the repulsive force of the compression spring 106"

Then, operations of components within the ink cartridge according to the embodiment will be described with reference to FIGS. 3A to 3C.

Figure 3A:
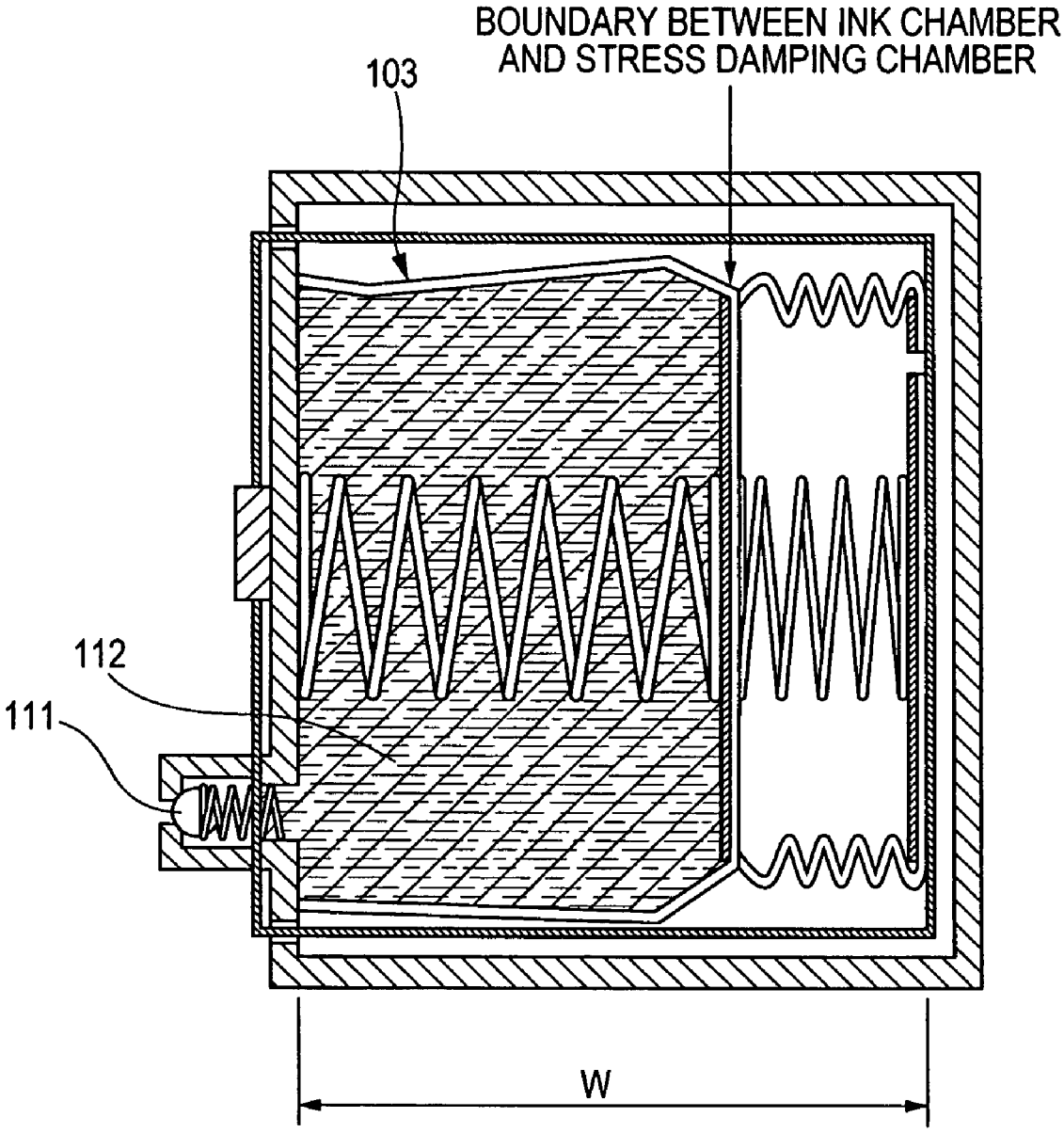
FIG. 3A is a drawing showing the ink cartridge when ink is consumed according to the second embodiment.
Figure 3B:
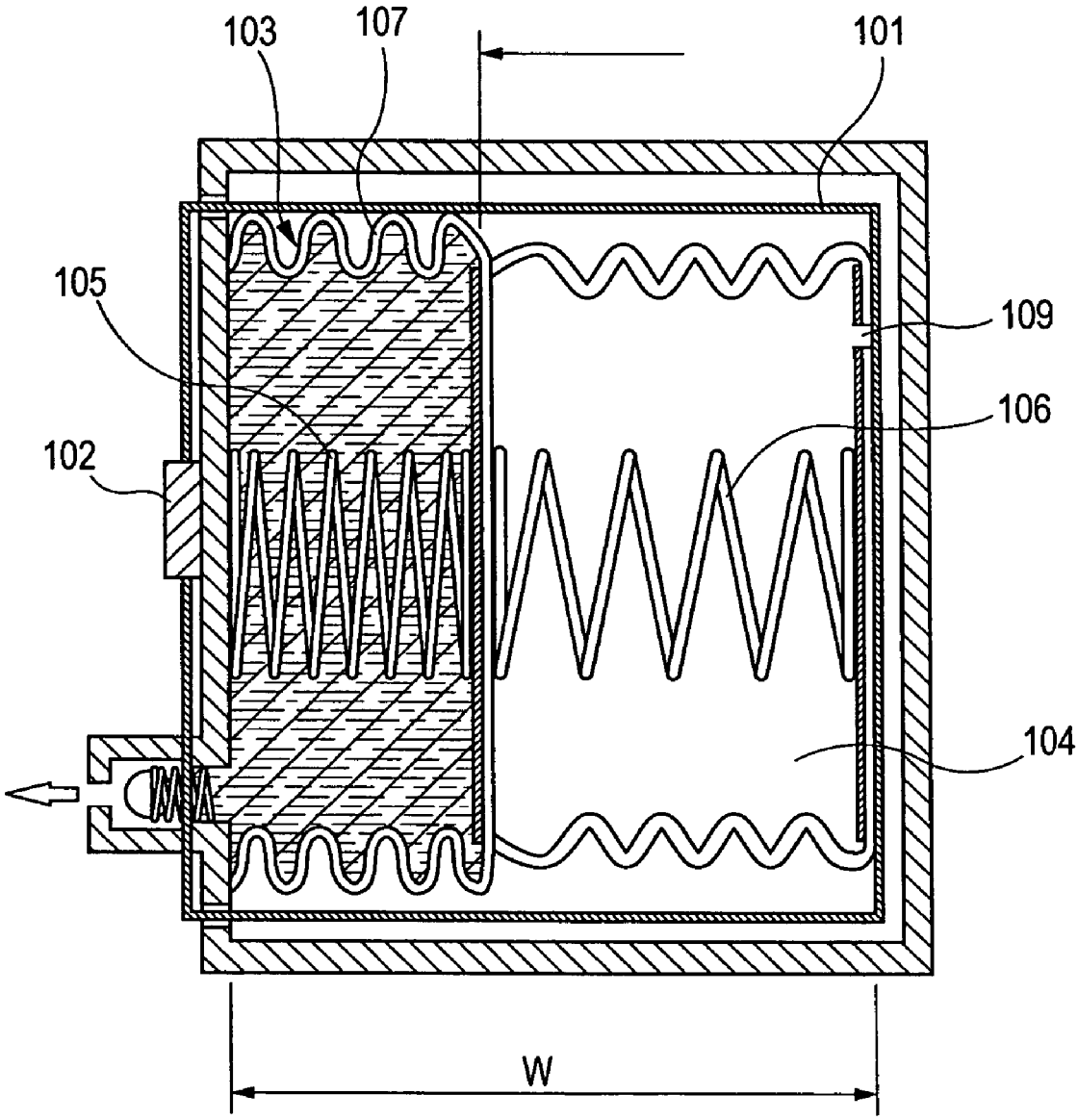
FIG. 3B is a drawing showing the ink cartridge when ink is consumed according to the second embodiment.
Figure 3C:
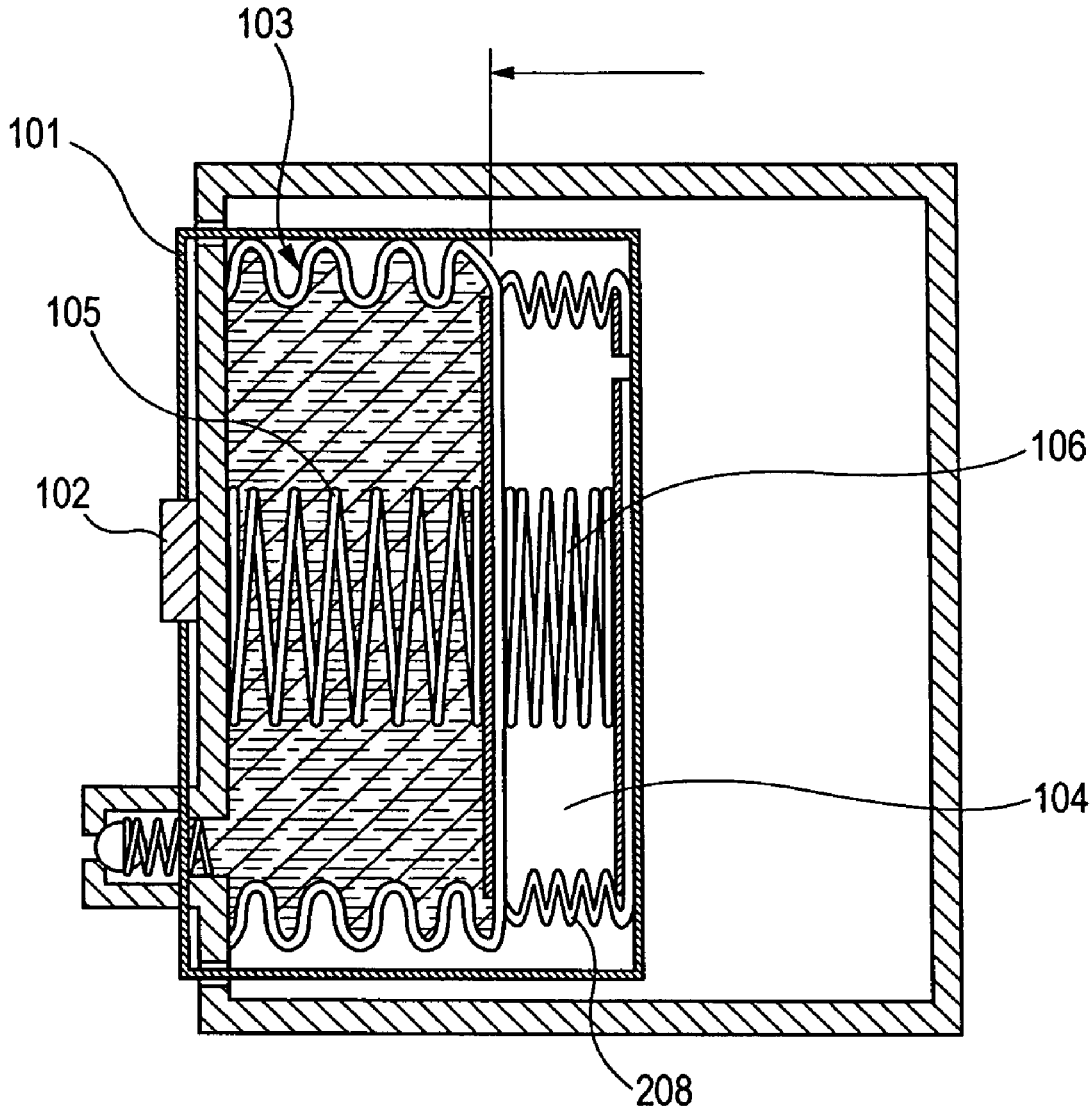
FIG. 3C is a drawing showing the ink cartridge when ink is consumed according to the second embodiment.

FIGS. 3A to 3C are drawings showing the ink being consumed according to the second embodiment.

When the ink supply port 111 is opened so as to supply the ink 112 to the head (not shown) from the state of FIG. 3A, the ink volume in the ink reservoir 103 decreases so as to displace the flexible bag 107 forming the ink reservoir 103 as shown in FIG. 3B. Along with this displacement, the compression spring 105 arranged within the ink reservoir 103 is compressed so that the boundary wall between the ink reservoir 103 and the stress damping chamber 104 is moved in the direction of the arrow shown in FIG. 3B. At this time, the compression spring 106 arranged in the stress damping chamber 104 is released in compression so as to expand. Air is absorbed into the stress damping chamber 104 via the air inlet 109 arranged in the stress damping chamber 104, and the volume of the stress damping chamber 104 increases. Thereby, the total width W of the ink reservoir 103 and the stress damping chamber 104 shown in FIGS. 3A and 3B does not change. As a result, the shape-memory alloy wire 101 arranged so as to surround part of the bonded structure composed of the ink reservoir 103 and the stress damping chamber 104 does not slack and maintains the initial state.

From such a state, by electrifying the shape-memory alloy wire 101 via the electric contact block 102, the flexible bag 208 shrinks due to the contraction of the shape-memory alloy wire 101. Thus, the compression spring 106 arranged within the stress damping chamber 104 compresses so as to increase its repulsive force. As a result, as shown in FIG. 3C, the boundary wall between the ink reservoir 103 and the stress damping chamber 104 moves in the arrow direction so that the negative pressure level in the ink reservoir 103 is reduced. Because when the shape-memory alloy wire 101 is operated and the compression spring 106 is compressed before the compression of the compression spring 105 so as to decrease the volume of the stress damping chamber 104, the impact generated by the contraction of the shape-memory alloy wire 101 is absorbed by the stress damping chamber 104, preventing the ink leakage from the ink reservoir 103 due to the impact.

The operation timing of the shape-memory alloy wire 101 is effective when printing with high duty ratio, supplying a large amount of ink in recovery operation, and when the negative pressure level in the ink cartridge is decreased by an increase in ink resistance due to an increase in ink physical properties (viscosity especially) with external environmental factors such as temperature changes. Such situations can be recognized from the printer, so that the shape-memory alloy wire 101 can be electrified via the electric contact block 102 with good timing by determining the situation from the printer.

As described above, according to the embodiment, the stress damping chamber 104 is arranged so as to connect it to part of the ink reservoir 103 (the flexible bag 107) of the whole raw-ink type ink cartridge; the stress damping chamber 104 is contracted using the shape-memory alloy wire 101 operated by a drive current applied from the printer so as to increase the repulsive force of the compression spring 106 arranged in the stress damping chamber 104; and by displacing the flexible bag 107 with the increased repulsive force, the negative pressure level in the ink reservoir 103 can be reduced. That is, when the negative pressure level in the ink reservoir is rapidly increased, by operating the shape-memory alloy wire 101, the negative pressure level can be improved. As a result, ink can be stably supplied, so that a reliable ink cartridge and inkjet recording apparatus that reduce printing nonconformity can be provided. The ink cartridge according to the embodiment is effective against external impact in the same way as in the first embodiment.

The shape-memory alloy wire 101 according to the embodiment expands/contracts with changing temperature by martensite transformation. As it has a high electric resistance, the shape-memory alloy wire 101 can easily be heated by electrification. Thus, the wire can be expanded/contracted by controlling the applied current. A product having such properties includes NT Wire for an electric current actuator (model NT-H7-TTR) manufactured by Furukawa Techno Material Co., LTD.

Third Embodiment

Figure 4:
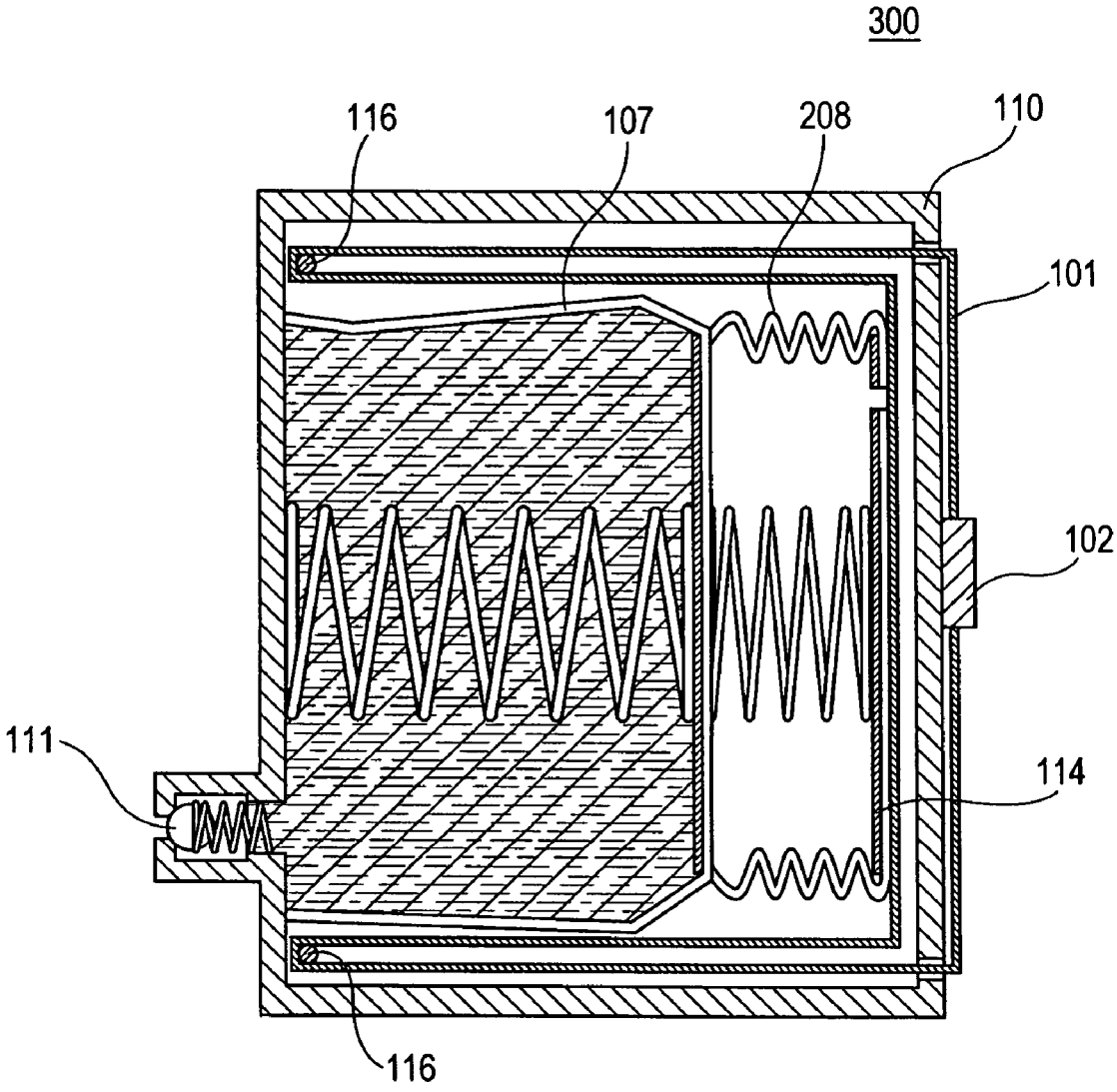
FIG. 4 is a sectional view of an ink cartridge according to a third embodiment of the present invention.

FIG. 4 is a sectional view of an ink cartridge according to a third embodiment of the present invention. An ink cartridge 300 according to the embodiment has basically the same configuration and operation as those of the second embodiment, and so description thereof is omitted.

The point in which the third embodiment differs from the second embodiment is that the electric contact block 102 for electrifying the shape-memory alloy wire 101 is arranged on a surface different from that of the casing 110 where the ink supply port 111 is provided. Thus, the shape-memory alloy wire 101 is folded to the interior of the casing 110 at a fulcrum 116 arranged in the vicinity of the wall of the casing 110 where the ink supply port 111 is formed.

According to the embodiment, an electrical defect can be prevented, which might be caused by the adhesion of ink leaked from the ink supply port 111 for supplying the ink to the exterior by some reason.

Other Embodiments

Figure 5:
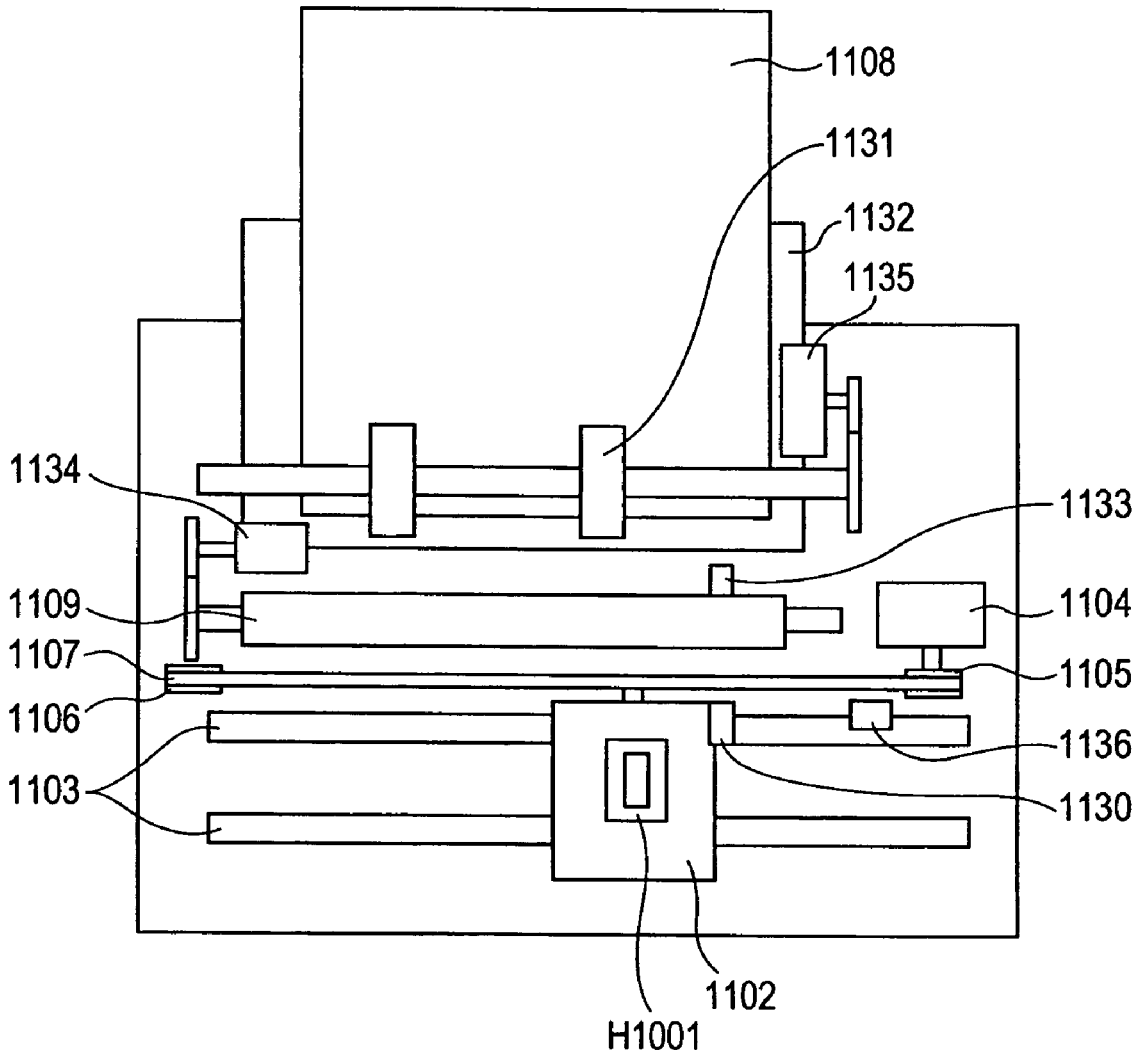
FIG. 5 is an explanatory drawing illustrating an example of a liquid-ejection recording apparatus capable of mounting a liquid storage container according to the present invention.
Figure 6:
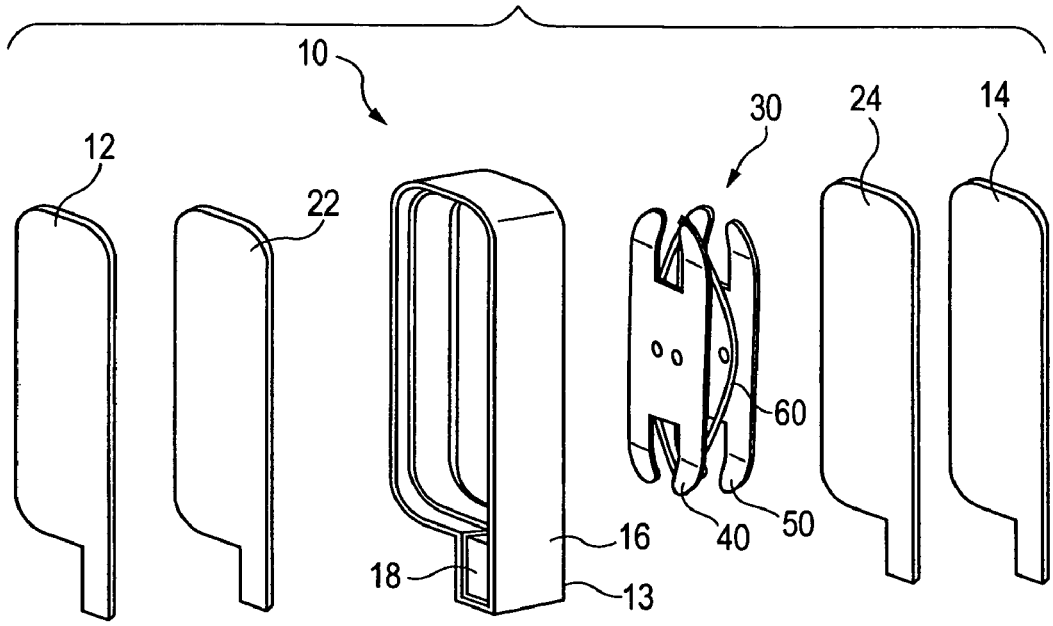
FIG. 6 PRIOR ART
FIG. 6 is an exploded view of the conventional ink cartridge disclosed in Japanese Patent Laid-Open No. H06-198904.
Figure 7:
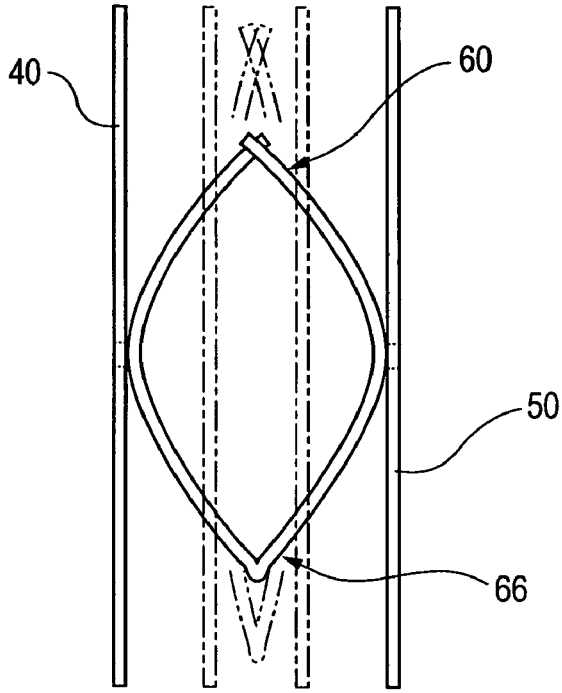
FIG. 7 PRIOR ART
FIG. 7 is an explanatory drawing illustrating the pressure regulator shown in FIG. 6.

Then, an inkjet recording apparatus (liquid ejection recording apparatus) according to another embodiment capable of mounting the ink cartridge described above thereon will be described. FIG. 5 is an explanatory drawing illustrating an example of the liquid ejection recording apparatus capable of mounting the ink cartridge according to the present invention thereon.

In the recording apparatus shown in FIG. 5, a recording head H1001 connected to the ink supply port 111 of the ink cartridge according to the embodiments described above is replaceably mounted on a carriage 1102. On the carriage 1102, an electric connection part (not shown) is provided for transmitting a drive signal to each discharge port train via the electric connection part on the recording head H1001.

The carriage 1102 is guided by a guide shaft 1103 arranged on an apparatus body so as to extend in a principal scanning direction so that the carriage 1102 can move back and forth along the guide shaft 1103. The carriage 1102 is driven by a principal scanning motor 1104 via a driving mechanism such as a motor pulley 1105, a driven pulley 1106, and a timing belt 1107 while being controlled in position and movement. The carriage 1102 is also provided with a home position sensor 1130 arranged thereon. Thus, the position can be known when the home position sensor 1130 on the carriage 1102 passes through the position of a shielding plate 1136.

At the position (home position) of the carriage where the home position sensor 1130 detects the shielding plate 1136, a cap 1137 is arranged for covering the front surface where ink discharge ports of the recording head H1001 are formed. The cap 1137 is used for recovering the recording head by absorbing ink via openings inside the cap by an absorbing element (not shown). The cap 1137 is moved by a drive force transmitted through gears so as to cover the ink discharge surface. A cleaning blade 1138 is provided in the vicinity of the cap 1137. These capping, cleaning, and absorption recovering are performed for the ink discharge surface of the recording head when the carriage 1102 is moved to the home position.

Recording media 1108, such as printing paper and plastic thin sheets, are separated one by one from an automatic sheet feeder 1132 (ASF below) by rotating a pick-up roller 1131 with a feed motor 1135 via gears. The sheet is further transferred (secondarily scanned) by the rotation of transfer rollers 1109 so as to pass through a position (printing position) opposing the ink discharge surface of the recording head. The transfer roller 1109 is rotated by the rotation of an LF motor 1134 via gears. During the transfer, the determination of whether the sheet is fed and the confirmation of a cue position when the sheet is fed are executed when a recording medium 1108 passes through a paper end sensor 1133. Moreover, the paper end sensor 1133 is also used for sensing the actual position of the trailing end of the recording medium 1108 so as to finally determine the present recording position from the trailing end.

The bottom surface of the recording medium 1108 is supported on a platen (not shown) so as to form a flat printing surface at the printing position. In this case, the discharge surface of the recording head H1001 mounted on the carriage 1102 protrudes downward from the carriage 1102 so as to be supported between two pairs of the transfer rollers in parallel with the recording medium 1108.

The recording head H1001 is mounted on the carriage 1102 so that the lining direction of discharge ports for each discharge port train intersects with the scanning direction of the carriage 1102 for recording by ejecting liquid from these discharge port trains.

According to the embodiments described above, an electrothermal conversion element is provided for generating thermal energy for ejecting ink. Alternatively, the present invention may incorporate other ink ejection systems such as a system using a vibration element.

The present invention, in addition to general printing apparatuses, may be applied to copying machines, facsimile machines with communication systems, word processors having printers, and industrial recording apparatuses combined with various processing devices. In such printing apparatuses for recording with carriage scanning, to the ink cartridge having scanning vibration applied thereto, the configuration of the present invention is effective such that ink can be stably fed so as to suppress the reduction in printing quality.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Application No. 2005-101929 filed Mar. 31, 2005, which is hereby incorporated by reference herein in its entirety.

What is claimed is:

1. A liquid storage container comprising:

a liquid reservoir adapted to store a liquid therein;

a first spring member accommodated within the liquid reservoir and urging the liquid reservoir so as to maintain the interior of the liquid reservoir at a negative pressure;

a casing having a wall and accommodating the liquid reservoir therein;

a supply port formed on the wall of the casing and facilitating supplying the liquid in the liquid reservoir to the outside;

a stress damping unit provided between the liquid reservoir and the wall of the casing, the stress damping unit damping stress applied to the liquid reservoir, wherein the stress damping unit is connected to the liquid reservoir in series in an expansion/contraction direction of the first spring member, wherein the stress damping unit includes a second spring member arranged within the air chamber in the expansion/contraction direction of the first spring member in series therewith, and the container further comprising:

a shape-memory alloy wire expanding/contracting by electric energy and being arranged within the casing so as to constrain the second spring member in a direction in which the stress damping unit contracts; and an electric contact unit arranged outside the casing and connected to both ends of the shape-memory alloy wire.

2. The container according to claim 1, wherein the stress damping unit includes an air chamber having an orifice allowing the air chamber to communicate with the atmosphere.

3. The container according to claim 1, wherein the electric contact unit is arranged at a position of the casing different from the wall of the casing where the supply port is formed.

4. A liquid ejection recording apparatus having the liquid storage container according to claim 3 mounted thereon.

5. A liquid ejection recording apparatus having the liquid storage container according to claim 1 mounted thereon.

* * * * *